US005615632A

United States Patent [19]

Nedderman, Jr.

[11] Patent Number: 5,615,632

[45] Date of Patent: Apr. 1, 1997

[54] UNDERWATER VEHICLE AND A FIN ASSEMBLY THEREFOR

[75] Inventor: William H. Nedderman, Jr., Middletown, R.I.

[73] Assignee: The United States of America as represented by the Secretary of the Navy, Washington, D.C.

[21] Appl. No.: 605,313

[22] Filed: Feb. 7, 1996

[51] Int. Cl.[6] ..... B63G 8/00

[52] U.S. Cl. ..... 114/330; 114/332

[58] Field of Search ..... 114/312, 330, 114/331, 332, 126

[56] References Cited

U.S. PATENT DOCUMENTS 1,250,987 12/1917 De Graw ..... 114/332

3,157,145 11/1964 Farris et al. ..... 114/332

*Primary Examiner*—Jesus D. Sotelo

*Attorney, Agent, or Firm*—Michael J. McGowan; James M. Kasischke; Prithvi C. Lall

[57] ABSTRACT

A fin assembly for an underwater vehicle, the assembly comprising a portion of the hull of the vehicle having a recess therein, and a sleeve proximate a forward end of the recess and inclined inwardly from the hull portion at an angle to the hull portion and inclined transversely of the fore-and-aft axis of the vehicle at an angle to the hull portion. The assembly further comprises a fin having a mounting post at a base end thereof, the post being at an angle to the lengthwise axis of the fin, and at an angle to a fore-and-aft axis of the fin. The post is disposed in the sleeve and turnable therein to move the fin from a first position in the hull recess wherein the fin is disposed generally axially of the vehicle and conformed to the hull portion, to a second position in which the fin extends outwardly from the hull in a position radial to the vehicle axis and inclined rearwardly at an angle from a line extending radially of the vehicle axis.

8 Claims, 4 Drawing Sheets

UNDERWATER VEHICLE AND A FIN ASSEMBLY THEREFOR

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

The invention relates to a fin assembly for an underwater vehicle and to an underwater vehicle having a plurality of such fin assemblies, and is directed more particularly to a fin assembly facilitating stowage of the fin externally of the vehicle and generally conformed to the vehicle body and operative to move the fin to extend generally radially from the vehicle with the fore-and-aft axis of the fin parallel to the fore-and-aft axis of the vehicle.

(2) Description of the Prior Art

Fins for unmanned underwater vehicles and of the type customarily used for directional control, have in practice been stowed within the vehicle to leave a clean uncluttered hull for expulsion from a submarine torpedo tube. After launch of the vehicle, the fins spring outwardly through slots provided in the hull. The stowage of the fins, which may number eight or more, within the hull has engendered space problems in the vehicle and it has been deemed desirable to locate such fins externally of the hull, but in such a manner as to not interfere with the launch of the vehicle from a torpedo tube.

SUMMARY OF THE INVENTION

It is, therefore, an object of the invention to provide a fin assembly for an underwater vehicle wherein the fins are, when not in operation, disposed outside the hull, but generally conformed to the hull, and are movable to a position extending outwardly from the hull.

A further object of the invention is to provide an underwater vehicle provided with a plurality of fins, each of the fins being movable from a position nested in a recess in the hull, with the fore-and-aft axis of the fin disposed generally normal to the fore-and-aft axis of the vehicle, to a position extending radially outwardly from the vehicle with the fore-and-aft axis of the fin generally parallel to the fore-and-aft axis of the vehicle.

A still further object of the invention is to provide means for movement of the fins from the nested position to the extended position which is simple, inexpensive, rugged, and includes a minimum of moving parts.

With the above and other objects in view, as will hereinafter appear, a feature of the present invention is the provision of a fin assembly for an underwater vehicle, the assembly comprising a portion of the hull of the vehicle having a recess therein, and a sleeve proximate a forward end of the recess and inclined inwardly from the hull portion at an angle to the hull portion and inclined transversely of the fore-and-aft axis of the vehicle at an angle to the hull portion. The assembly further comprises a fin having a mounting post at a base end thereof, the post being at an angle to the lengthwise axis of the fin, and at an angle to a fore-and-aft axis of the fin. The post is disposed in the sleeve and turnable therein to move the fin from a first position in the hull recess wherein the fin is disposed generally axially of the vehicle and conformed to the hull portion, to a second position in which the fin extends outwardly from the hull in a position radial to the vehicle axis and inclined rearwardly.

In accordance with a further feature of the invention, there is provided an underwater vehicle comprising a hull having a portion substantially cylindrical in configuration and having therein a plurality of recesses, a sleeve proximate a forward end of each of the recesses and inclined inwardly and transversely of the hull. The vehicle further includes a plurality of fins equal in number to the plurality of recesses, each of the fins having at a base end thereof a post extending at an angle fore-and-aft of the fin and at an angle widthwise of the fin. Each of the fin posts is disposed in one of the sleeves. The angles are such that rotation of the posts in the sleeves causes movement of each of the fins from a position nested in one of the recesses with the fore-and-aft axis of the fin disposed generally normal to the fore-and-aft axis of the vehicle, to a position extending outwardly from the vehicle with the fore-and-aft axis of the fin generally parallel to the fore-and-aft axis of the vehicle.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
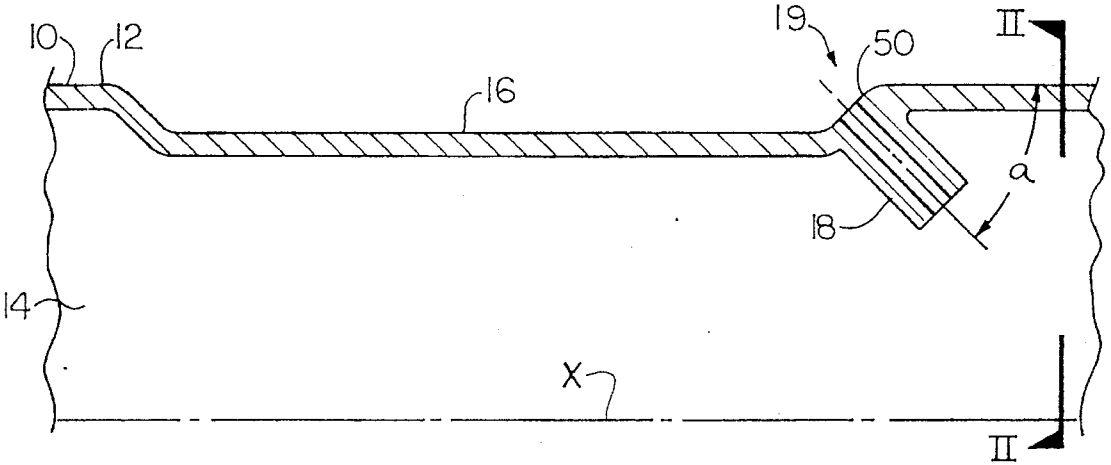
FIG. 1 is a centerline sectional view of an underwater vehicle hull portion.
Figure 2:
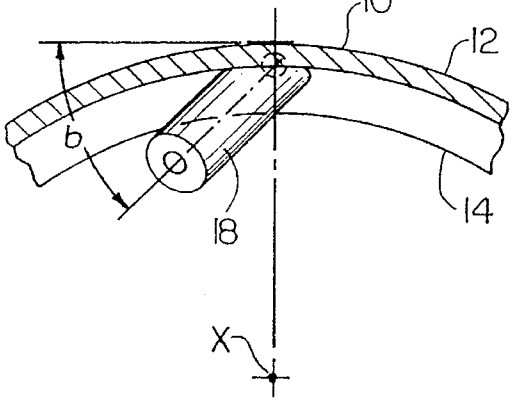
FIG. 2 is a transverse sectional view, taken along line II—II of FIG. I.

Referring to FIGS. 1 and 2, it will be seen that the assembly includes a portion 10 of a hull 12 of a vehicle 14. The hull portion 10 has therein an elongated recess 16. A sleeve 18 is proximate a forward end 19 of recess 16 at a first angle a to hull portion 10 (FIG. 1) and inclined transversely of the fore-and-aft axis X of vehicle 14 at a second angle b to hull portion 10 (FIG. 2).

Figure 3:
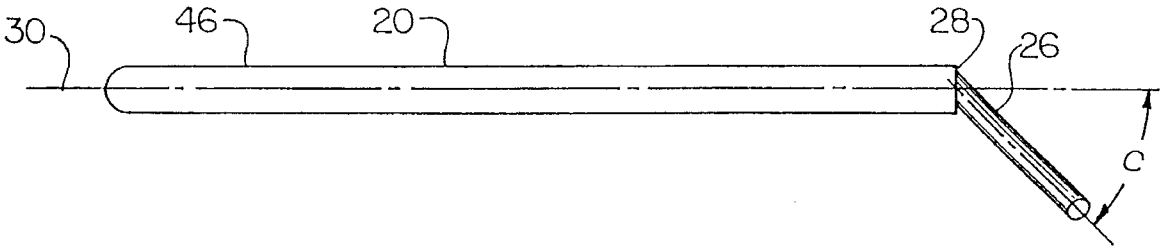
FIG. 3 is a front elevational view of a fin.
Figure 4:
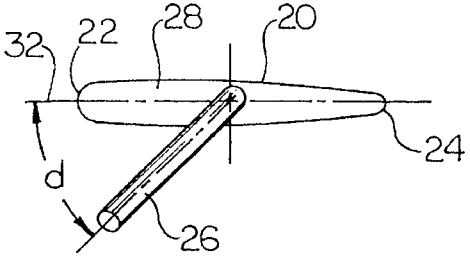
FIG. 4 is a base end view of the fin of FIG. 3.

Referring to FIGS. 3 and 4, it will be seen that the assembly includes a fin 20 having a leading edge 22 and a trailing edge 24. The fin 20 is provided with a mounting post 26 at a base end 28 of fin 20. The post 26 is at a third angle c (FIG. 3) to a lengthwise axis 30 of fin 20, and at a fourth angle d (FIG. 4) to a fore-and-aft axis 32 of fin 20.

Figure 5:
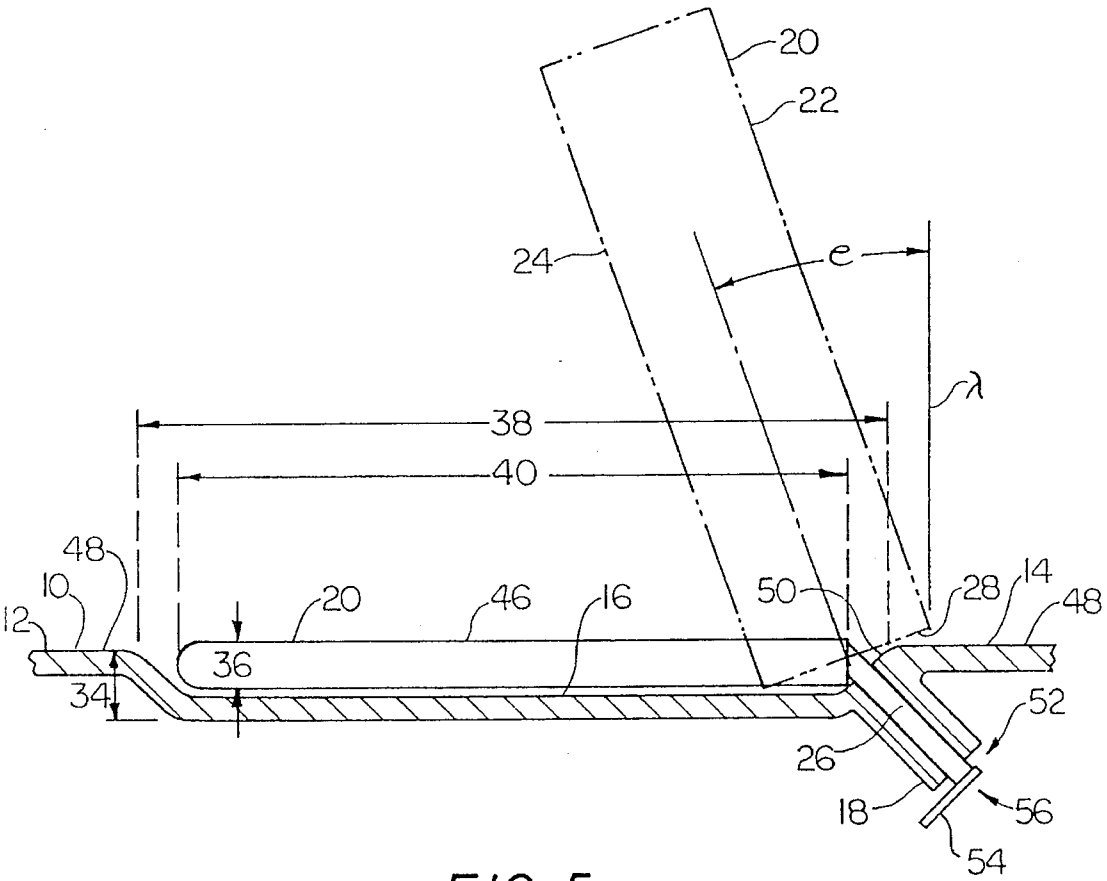
FIG. 5 is a partially sectional and partially elevational view of a fin assembly wherein the fin of FIGS. 3 and 4 is shown in combination with the hull portion of FIGS. 1 and 2, and is illustrative of an embodiment of the invention.

Referring to FIG. 5, it will be seen that mounting post 26 is disposed in sleeve 18 and is turnable in sleeve 18 to move fin 20 from a first position in hull recess 16 wherein fin 20 is disposed generally axially of vehicle 14 and generally conformed to hull portion 10, to a second position (FIG. 5 phantomed) in which fin 20 extends outwardly from hull 12 in a position radial to the vehicle axis (FIG. 6) and inclined rearwardly at a fifth angle e (FIG. 5) from a line λ extending radially from the vehicle axis x.

Figure 6:
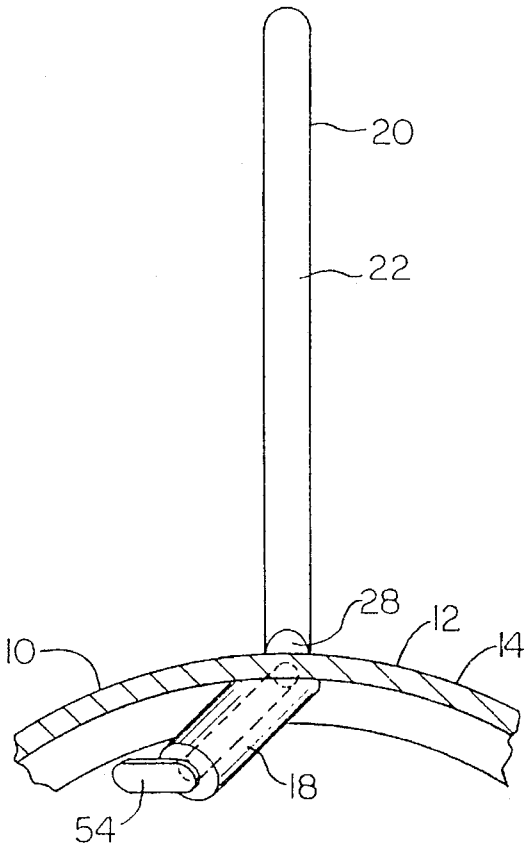
FIG. 6 is a partially sectional and partially front elevational view of the assembly of FIG. 5.
Figure 7:
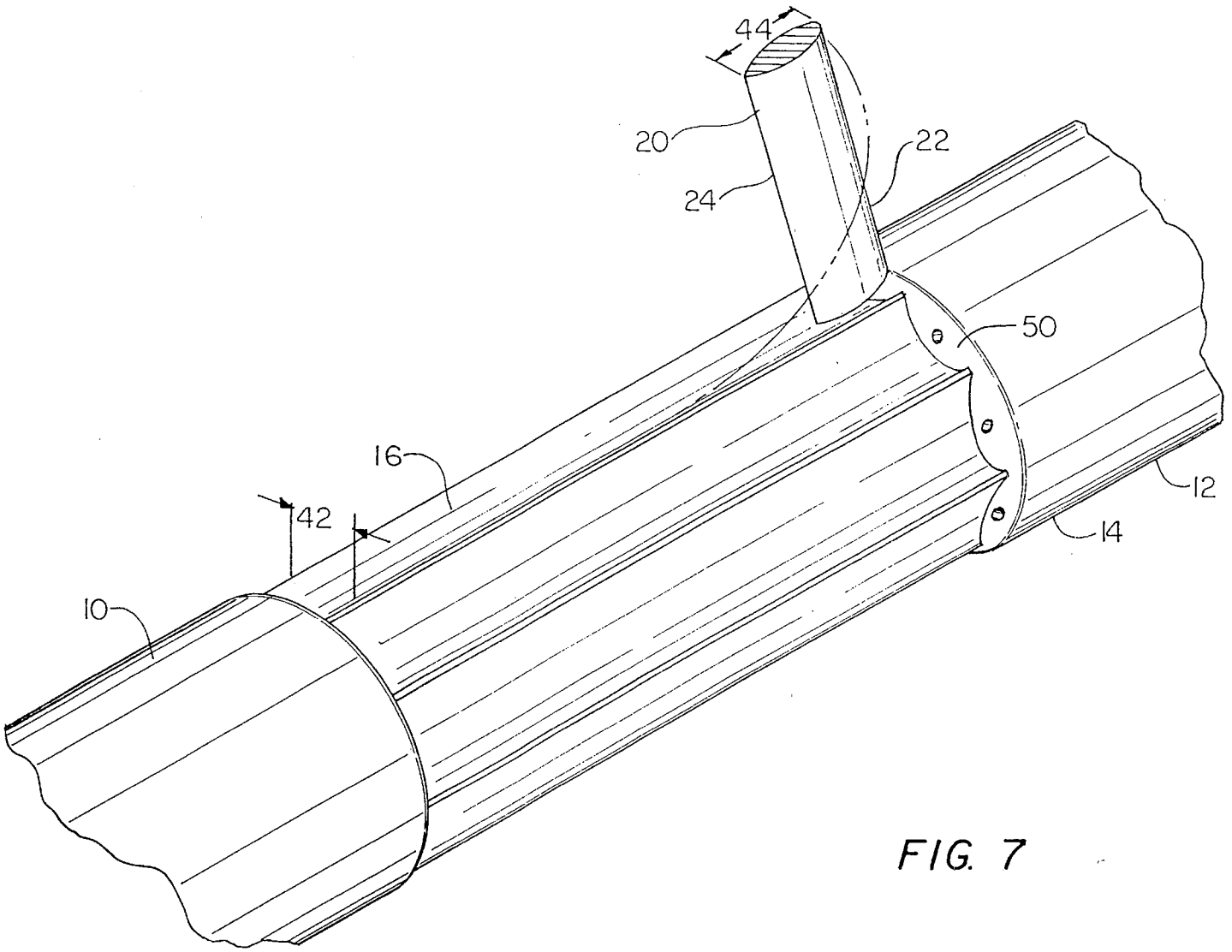
FIG. 7 is a perspective view of the assembly of FIGS. 5 and 6.

As seen in FIGS. 2, 6 and 7, hull portion 10 is, in transverse section, of an arc-shaped configuration and recess 16 (FIGS. 1, 5 and 7) is elongated lengthwise of hull portion 10. Recess 16 is of a depth 34 (FIG. 5) not less than the thickness 36 of fin 20, and is of a length 38 not less than the length 40 of fin 20, and is of a width 42 (FIG. 7) not less than the width 44 of fin 20, such that fin 20 is received by recess 16 with a major surface 46 (FIG. 5) of fin 20 generally conforming to the surface 48 of hull portion 10.

In the embodiment illustrated in FIGS. 1–7, sleeve 18 extends inwardly and transversely from a forward wall 50 of recess 16 (FIGS. 1 and 5). To facilitate rotation of mounting post 26, a free end 52 (FIG. 5) of post 26 is provided with an arm 54 fixed to post 26, such that rotative movement of arm 54 about a pivot point 56, defined by post 26, causes rotational movement of post 26, and thereby fin 20, to move fin 20 from the aforesaid first position to the aforesaid second position, as shown in FIG. 5.

In a preferred embodiment, angles a, b, c and d are approximately 45°, and angle e is approximately 19.5°. It will be apparent that the angles selected depend upon the desired second position for the fin 20.

Figure 8:
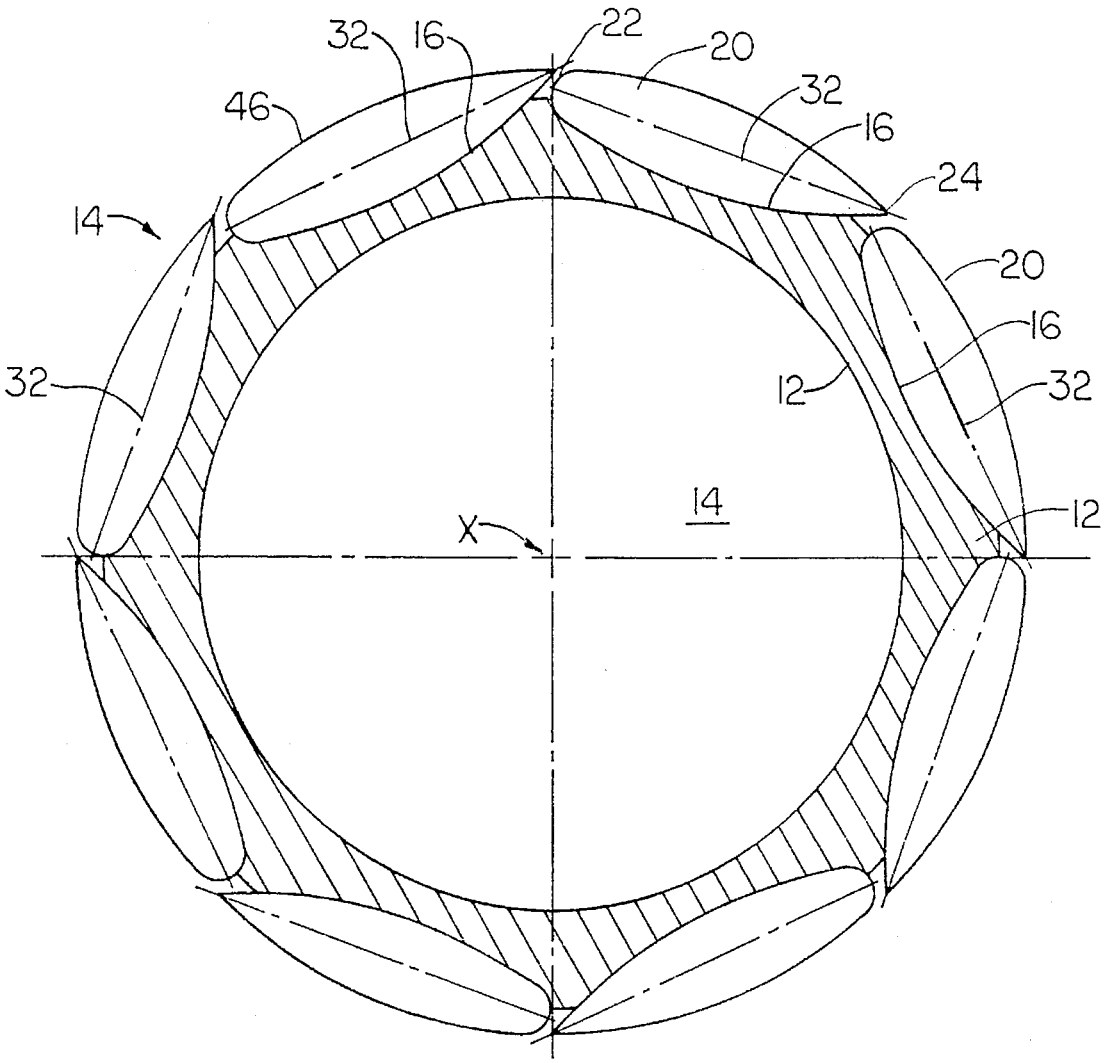
FIG. 8 is a diagrammatic illustration of the positioning of a plurality of fins in a vehicle.

In virtually all instances a plurality of the above-described fin assemblies is required, typically four or eight fin assemblies. In FIG. 8, there is shown diagrammatically an arrangement of eight fins 20 in recesses 16 disposed around the circumference of hull 12. Each fin assembly of an arrangement as depicted in FIG. 8 is in accordance with the above description.

In operation, the vehicle 14 is launched in the condition illustrated in FIG. 8. After exiting the launch tube, a motive means operates to rotate posts 26, as by rotation of arms 54. Upon rotation of posts 26, all fins 20 extend from their recess 16 and turn so that the fore-and-aft axes 32 of the fins are generally parallel with the fore-and-aft axis x of the vehicle 14. To return fins 20 to their nested positions, counter rotation of posts 26 is undertaken.

It is to be understood that the present invention is by no means limited to the particular construction herein disclosed and/or shown in the drawings, but also comprises any modifications or equivalents within the scope of the claims.

What is claimed is:

1. Fin assembly for an underwater vehicle, said assembly comprising:

a portion of the hull of said vehicle being substantially cylindrical in configuration and having a recess therein;

a sleeve proximate a forward end of said recess and inclined from said hull portion at a first angle to said hull portion and inclined transversely of the fore-and-aft axis of said vehicle at a second angle to said hull portion; and a fin having a mounting post at a base end thereof, said post being at a third angle to a lengthwise axis of said fin, and at a fourth angle to a fore-and-aft axis of said fin;

said post being disposed in said sleeve and being turnable therein to move said fin from a first position in said hull recess wherein said fin is disposed with the fore-and-aft axis of said fin disposed generally normal to the fore-and-aft axis of said vehicle and is generally conformed to said hull portion, to a second position in which said fin extends outwardly from said hull in a position radial to said vehicle axis and inclined rearwardly at a fifth angle from a line extending radially of said vehicle axis, with said fore-and-aft axis of said fin generally parallel to the fore-and-aft axis of said vehicle.

2. A fin assembly for an underwater vehicle, said assembly comprising:

a portion of the hull of said vehicle having a recess therein, wherein said hull portion is, in transverse section, of an arc-shaped configuration and said recess is elongated lengthwise of said hull portion, and of a depth not less than the thickness of said fin, of a length not less than the length of said fin, and of a width not less than the width of said fin, such that said fin is received by said recess with a major surface of said fin generally conforming to the surface of said hull portion;

a sleeve proximate a forward end of said recess and inclined from said hull portion at a first angle to said hull portion and inclined transversely of the fore-and-aft axis of said vehicle at a second angle to said hull portion; and a fin having a mounting post at a base end thereof, said post being at a third angle to a lengthwise axis of said fin, and at a fourth angle to a fore-and-aft axis of said fin;

said post being disposed in said sleeve and being turnable therein to move said fin from a first position in said hull recess wherein said fin is disposed generally axially of said vehicle and generally conformed to said hull portion, to a second position in which said fin extends outwardly from said hull in a position radial to said vehicle axis and inclined rearwardly at a fifth angle from a line extending radially of said vehicle axis.

3. The assembly in accordance with claim 2 wherein said sleeve extends from a wall located at said forward end of said recess.

4. The assembly in accordance with claim 3 further comprising an arm fixed to a free end of said post such that rotative movement of said arm about a point on the axis of said post causes rotational movement of said post, to cause movement of said fin from said first position to said second position.

5. The assembly in accordance with claim 2 wherein said first angle is about 45°, and said second angle is about 45°.

6. The assembly in accordance with claim 5 wherein said third angle is about 45°, and said fourth angle is about 45°.

7. The assembly in accordance with claim 6 wherein said fifth angle is about 19.5°.

8. An underwater vehicle comprising:

a hull having a portion substantially cylindrical in configuration and having therein a plurality of recesses;

a sleeve proximate a forward end of each of said recesses and inclined inwardly and transversely of said hull;

and a plurality of fins equal in number to said plurality of recesses, each of said fins having at a base end thereof a post extending at an angle fore-and-aft of said fin and at an angle widthwise of said fin;

said fin posts each being disposed in one of said sleeves;

said angles being such that rotation of said posts in said sleeves causes movement of each of said fins from a position nested in one of said recesses with the fore-and-aft axis of said fin disposed generally normal to the fore-and-aft axis of said vehicle to a position extending outwardly from said vehicle with said fore-and-aft axis of said fin generally parallel to the fore-and-aft axis of said vehicle.

* * * * *